United States Patent [19]

Kilmartin et al.

[11] Patent Number: 4,553,657

[45] Date of Patent: Nov. 19, 1985

[54] MAGNETICALLY SELECTIVE TOKEN SYSTEM

[75] Inventors: David F. Kilmartin, Glocester, R.I.; David F. Kilmartin, Jr., North Attleboro, Mass.; Albinas A. Cibulsky, North Providence, R.I.

[73] Assignee: Kilmartin Industries, Inc., Attleboro, Mass.

[21] Appl. No.: 580,092

[22] Filed: Feb. 10, 1984

[51] Int. Cl.[4] ..... G07D 5/08; G07F 7/00

[52] U.S. Cl. ..... 194/4 R; 194/4 F; 194/101

[58] Field of Search ..... 194/4 R, 4 C, 4 F, 4 G, 194/101; 235/449, 493

[56] References Cited

U.S. PATENT DOCUMENTS

| | | | |
|---|---|---|---|
| 3,211,267 | 10/1965 | Bayha | 194/4 C X |
| 3,397,764 | 8/1968 | Simjian | 194/4 R |
| 4,006,342 | 2/1977 | Baumann et al. | 194/4 F X |

FOREIGN PATENT DOCUMENTS

| | | | |
|---|---|---|---|
| 2809518 | 9/1979 | Fed. Rep. of Germany | 194/101 |

*Primary Examiner*—F. J. Bartuska

*Attorney, Agent, or Firm*—Salter & Michaelson

[57] ABSTRACT

A magnetically selective token system comprises valid tokens which are nonmagnetically responsive in the peripheral portions thereof and responsive in the central portions thereof and a token acceptor which is operative for segregating valid tokens from various types of counterfeit tokens. Unspecified tokens inserted into the acceptor are individually passed to an upper token station where first magnetic elements are operative for magnetically communicating with only the peripheral portions of the tokens so that counterfeit tokens having magnetically responsive peripheral portions are retained at the upper station, whereas other types of unspecified tokens are individually passed to a lower station. Second magnetic elements are operative for magnetically communicating with the central portions of tokens at the lower station so that valid tokens are retained at the lower station, whereas nonmagnetically responsive counterfeit tokens pass to a first outlet slot. The acceptor is operative for removing counterfeit tokens from the upper station and guiding them to the first outlet slot and for removing valid tokens from the lower station and guiding them to a second outlet slot so that they are segregated from the counterfeit tokens. The method of segregating valid tokens from counterfeit tokens includes the steps of exposing only the peripheral portions of unspecified tokens to first magnetic elements to separate out magnetically responsive counterfeit tokens and then exposing the central portions of the remaining token to second magnetic elements to separate out valid tokens.

20 Claims, 9 Drawing Figures

MAGNETICALLY SELECTIVE TOKEN SYSTEM

BACKGROUND AND SUMMARY OF THE INVENTION

The instant invention relates to token systems and more particularly to a magnetically selective token system which is operative for discriminating between valid tokens and counterfeit tokens.

The value of token systems in general for use in various types of applications, including transit system and gaming device applications, has long been recognized. In this regard, token systems have generally proven to be effective and efficient for mechanically securing payment from customers and for mechanically actuating various types of system devices in response thereto. For example, token systems have proven to be effective for collecting tolls and fees in transit and highway systems and for actuating various types of tollgate and turnstile mechanisms in response thereto, and they have also proven to be effective for collecting fees and actuating various types of mechanisms in gaming devices. Token systems have generally proven to be attractive from the standpoint of minimizing theft in fee collection systems, since tokens in themselves generally have little or no intrinsic cash value. Further, token systems have proven to have advantages over other types of mechanical fare collection systems, since fares can be raised or lowered without requiring any mechanical system changes simply by changing the prices charged for tokens. Fare schedules wherein different rates are charged to different customer groups can also be easily and effectively administered with token systems.

While token systems in general have had the advantages hereinabove set forth over other types of currency systems, as well as various other advantages, counterfeiting has frequently been a serious problem with many token systems. In this connection, because many of the heretofore available token systems have merely been operative for discriminating between valid tokens of a particular size and other improperly-sized counterfeit tokens, the use of counterfeit tokens or slugs which are the same size as the valid tokens has often been widespread with systems of this type. While other types of token systems have been operative for discriminating between valid nonferrous tokens and counterfeit tokens or slugs made of magnetically responsive materials such as steel, these systems have nevertheless been susceptible to counterfeiting with slugs or counterfeit tokens made of nonferrous materials. Further, instances have occurred wherein valid tokens from a first system have been operative in a second token system designed for more expensive tokens, and this has resulted in a major breakdown of the second system.

Separate and apart from the problem of counterfeiting, a token system should be relatively simple in its operation so that it can be reliably used with a minimum of attention and/or maintenance. Further, a token system should be able to accept and reject counterfeit tokens without jamming, and a token system should be relatively rugged so that it can remain in service for a prolonged period of time without requiring maintenance.

While for many token system applications, such as gaming device applications and the like, the main function of a token system is to mechanically segregate valid tokens from counterfeit tokens, other types of token system applications, such as tollgate and turnstile applications, require a token system to also be operative for actuating other types of secondary system devices. For example, a token system used in a tollgate system application must be operative for actuating the operation of a gate or the like when a valid token is received in the system and for processing counterfeit tokens so that they pass through the system without causing the gate to be opened.

Several known token systems representing the closest prior art to the instant invention of which the applicant is aware are disclosed in the U.S. patents to Peirce Nos. 517,012; Schmidt 800,174; Wurzbach et al. 1,732,826; Vogel 2,339,823; Stewart 3,452,849; and Pennell 3,556,276. However, while these references teach a variety of token systems, they fail to disclose or suggest a token system which is operative in the novel manner of the token system of the instant Invention. Specifically, the token system of the instant invention is operative for discriminating between tokens which are magnetically responsive in the central portions thereof and nonresponsive in the peripheral portions thereof and other types of tokens, such as those made entirely of magnetically responsive or nonmagnetically responsive materials. Conceptually, this represents a significant departure from the systems disclosed in the above references, and for this reason as well as for a number of other reasons which will hereinafter be made apparent, the above references are believed to be of nothing more than general interest with respect to the instant invention.

The instant invention provides a unique token system comprising one or more valid tokens which are magnetically responsive in the central portions thereof and nonresponsive in the peripheral portions thereof, and a token acceptor which is operative for discriminating between valid tokens and other types of counterfeit tokens, especially those made entirely of magnetically responsive or nonmagnetically responsive materials. The token acceptor of the instant invention comprises an acceptor body made of a nonmagnetically responsive material having a token inlet slot therein for receiving tokens in the body, and first and second token outlet slots for releasing tokens from the body. A first magnetic means of the acceptor is operative for selectively magnetically communicating with the peripheral edge portions of a token but not the other portions thereof when the token is positioned at an upper token station in the body, and a second magnetic means of the acceptor is operative for magnetically communicating with the nonperipheral edge portions of the token when it is positioned at the lower token station in the body. When a valid token is positioned in the inlet slot, it first passes to the upper station; but since it is substantially unaffected by the first magnetic means at the upper station, it passes from the upper station to the lower station where it is magnetically retained. On the other hand, when a counterfeit token, such as a slug which is made entirely of a magnetically responsive material, is inserted into the inlet slot, it is magnetically retained at the upper station; and when a counterfeit token made entirely of a nonmagnetically responsive material such as brass is inserted into the inlet slot, it can pass freely through both the upper and lower stations, being unaffected by either of the first or second magnetic means. The acceptor is constructed so that when a nonmagnetically responsive counterfeit token passes through both the upper and lower stations, it automatically passes into the first outlet slot where it is released from the acceptor, and means is provided in the acceptor for removing a magnetically responsive counterfeit token from the upper station and for guiding it to the first outlet slot where it also is released. Further, means is provided for removing a valid token from the lower station and for guiding it to the second outlet slot where it is released from the acceptor. Accordingly, it is seen that the acceptor is operative for discriminating between valid tokens which are nonmagnetically responsive in the peripheral portions thereof and magnetically responsive in the central portions thereof and counterfeit tokens which are made either entirely of nonmagnetically responsive materials, entirely of magnetically responsive materials, or are at least made of magnetically responsive materials in at least the peripheral portions thereof. Further, the acceptor is operative for segregating valid tokens from counterfeit tokens so that counterfeit tokens pass through the first outlet slot, whereas valid tokens pass through the second outlet slot. In addition to being operative for segregating valid tokens from counterfeit tokens, the acceptor is also operative for actuating various types of secondary system devices, such as turnstiles, tollgates, etc. More specifically, the acceptor is operative so that when a valid token is received therein, the valid token triggers or actuates the operation of a secondary system actuating device as it is moved from the lower station to the second outlet slot.

In the preferred embodiment of the token system of the instant invention, the means for removing counterfeit tokens from the upper station and the means for removing valid tokens from the lower station are integrally formed and comprise a slide which is mounted in the acceptor body so that it is generally laterally slidable with respect to the inlet slot, and the first and second magnetic means are mounted on the slide. The slide is operative between a first position wherein the first and second magnetic means are disposed at the upper and lower stations, respectively, and a second position wherein the first and second magnetic means are positioned so that they are not in communication with either of the upper or lower stations. By positioning the slide in the first position thereof, the acceptor is operative for retaining a magnetically responsive counterfeit token at the upper station; and when the slide is moved to its second position, the magnetically responsive counterfeit token drops into the first outlet slot. On the other hand, when the slide is in its first position, it is also operative for retaining a valid token at the lower station; and when the slide is moved to its second position, it carries the valid token with it to a point adjacent the second outlet slot where a wiper assembly of the acceptor engages the valid token to pass it into the second outlet slot where it is released. Further, in this embodiment of the acceptor, when the valid token is carried by the slide during movement of the slide to its second position, the valid token is held in a position wherein it is engageable with a secondary system actuating device, such as a turnstile actuating mechanism. When the acceptor is used in a system of this type, means are normally provided in the secondary system for preventing the slide from being fully moved to its second position unless a release mechanism of the secondary system is actuated during the initial movement of the slide from its first position. In this regard, when the acceptor is operated with a valid token, the valid token is held in a position wherein it is engageable with the release mechanism of the secondary system actuating device during the first portion of the slide travel. This causes the secondary system to be actuated so that the slide is permitted to travel to its second position, whereby the valid token passes into the second outlet slot and a counterfeit token positioned at the upper station passes into the first outlet slot. On the other hand, if a valid token is not positioned at the lower station and an attempt is made to move the slide to its second position, the release mechanism will not be actuted so that the slide will be prevented from traveling to its second position. Hence, the acceptor performs the discriminating function hereinabove described, as well as the function of actuating the operation of the secondary system when a valid token is received in the acceptor. Further, because of the unique way in which the token system segregates valid tokens from counterfeit tokens and the way in which it is operative for actuating a secondary system actuating device, it is highly reliable for performing these operations so that it can be effectively used for a variety of commercial applications. Further, since the acceptor of the instant invention is operative with a minimum of moving parts, it can be reliably operated for extended periods of time without jamming and without requiring maintenance. Accordingly, for these reasons, as well as a number of other reasons which will hereinafter be made apparent, the token system of the instant invention is highly attractive for applications such as in gaming systems and in tollgate and turnstile mechanisms of the type used for highway and transit systems.

Accordingly, it is a primary object of the instant invention to provide an effective token system wherein a token acceptor reliably segregates valid tokens from counterfeit tokens.

Another object of the instant invention is to provide an effective token system which is operative for segregating valid tokens from counterfeit tokens and for actuating the operation of a secondary system actuating device in response to receiving a valid token.

A still further object of the instant invention is to provide a highly reliable magnetically selective token system.

Still another object of the instant invention is to provide a token system which is selectively responsive to tokens which are magnetically responsive in the central portions thereof but nonmagnetically responsive in the peripheral portions thereof.

An even further object of the instant invention is to provide an effective token system which is operative with a minimum of moving parts.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
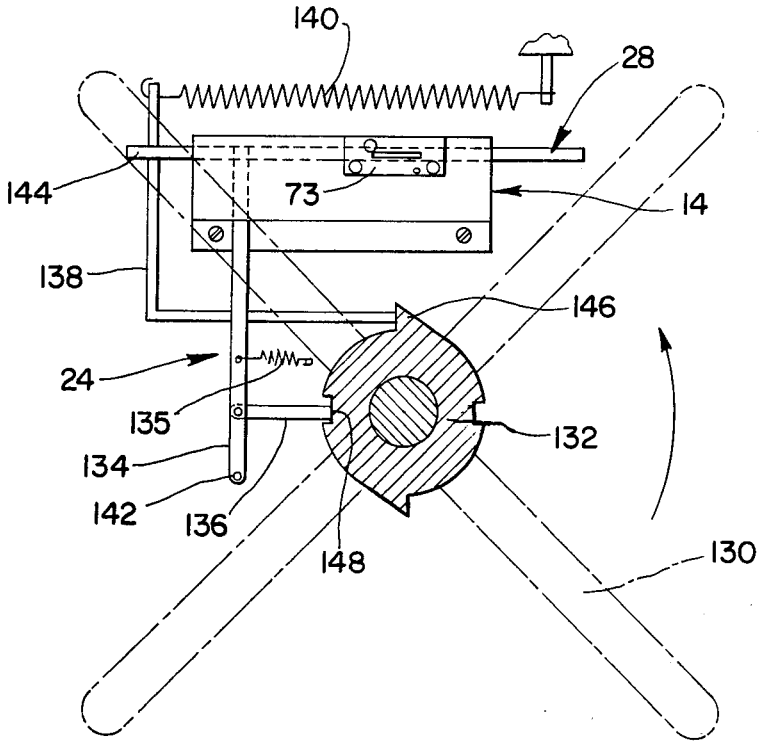
FIG. 1 is a schematic plan view of the token acceptor of the instant invention in combination with a turnstile system.

Referring now to the drawings, the magnetically selective token system of the instant invention is illustrated and generally indicated at 10 in FIGS. 5 through 9. The token system 10 comprises a valid token generally indicated at 12 in FIG. 2 and a token acceptor generally indicated at 14 in FIG. 1 and FIGS. 3 through 9. The valid token 12 is preferably of substantially flat, circular configuration and comprises a peripheral portion 16 which is made of a nonmagnetically responsive material and a central portion 18 which comprises a magnetically responsive material. The acceptor 14 is operative for discriminating between the valid token 12 and other types of tokens, such as the counterfeit tokens 20 and 22, illustrated in FIG. 2 which are made entirely of nonmagnetically responsive and entirely of magnetically responsive materials, respectively. Further, the acceptor 14 is operative for segregating valid tokens 12 from the tokens 20 and 22 and for actuating the operation of a secondary system device, such as the turnstile assembly schematically illustrated in FIG. 1 and generally indicated at 24 in response to receiving a valid token 12.

The token 12 comprises the nonmagnetically responsive peripheral portion 16 which is preferably made of a nonferrous metal, such as brass, and the magnetically responsive nonperipheral or central portion 18 which is preferably made of a ferrous metal, such as steel. The counterfeit tokens 20 and 22 comprise counterfeit slugs which may be constructed entirely of brass and entirely of steel, respectively. It will be understood, however, that the acceptor 14 is generally operative for rejecting virtually all types of counterfeit tokens other than counterfeit tokens constructed similar to the valid token 12, i.e., other than counterfeit tokens having nonmagnetically responsive peripheral portions and magnetically responsive central portions.

The acceptor 14 comprises an acceptor body generally indicated at 26, a slide generally indicated at 28 which is slidably mounted in the body 26, a pair of laterally spaced first magnets 30 which are mounted on the slide 28, a pair of close vertically spaced second magnets 32 which are also mounted on the slide 28, a wiper mechanism generally indicated at 34, and an escrow mechanism generally indicated at 36.

Figure 9:
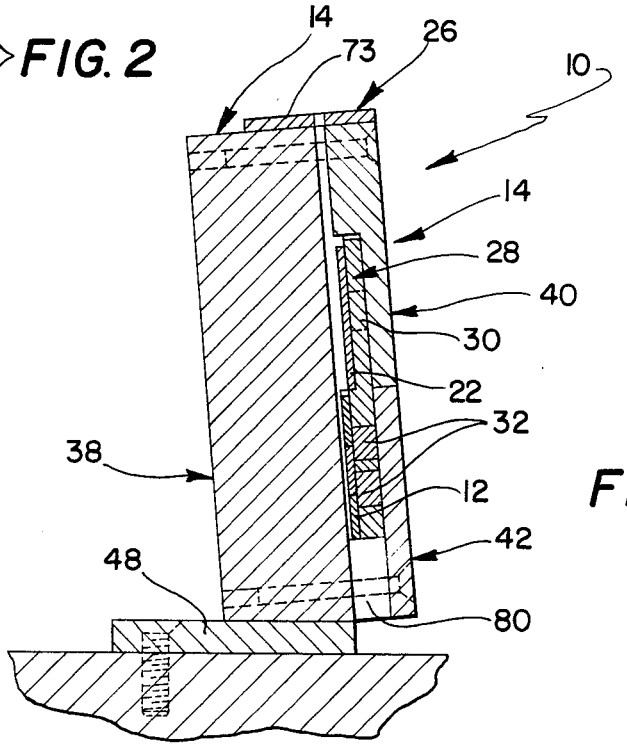
FIG. 9 is a side sectional view of the acceptor.

The body 26 is preferably constructed of a nonmagnetically responsive material and comprises a main body portion generally indicated at 38 and upper and lower body panels 40 and 42, respectively, which are secured to the main portion 38 with screws 44. The main portion 38 is preferably mounted on a base 48, so that when the base 48 is disposed in a substantially horizontal plane, the body 26 is inclined slightly from the vertical toward the main portion 38, as illustrated in FIG. 9, for reasons which will hereinafter be set forth.

The main portion 38 and the panels 40 and 42 cooperate to define a network of slots for receiving and segregating valid tokens from counterfeit tokens in the acceptor 14, and they cooperate to mount the slide 28, the wiper mechanism 34 and the escrow mechanism 36 in the acceptor 14. In this regard, a generally downwardly extending channel 50 is formed in the main portion 38, and mating portions 52 and 54 are provided on the opposite sides of the upper portion of the channel 50, whereas raised portions 56 and 58 are formed on the opposite sides of the lower portion of the channel 50. The main body portion 38 is further formed with a generally planar surface 60 in the lower portion thereof which extends from the channel 50, and an escrow mechanism recess 62 is provided below the raised portion 56 adjacent the lower portion of the channel 50. A wiper mechanism recess 64 is formed in the main portion 38 below the raised portion 58, and a generally laterally extending actuator slot 66 extends through the main portion 38, passing through the recess 64. The upper panel 40 is formed with an enlarged upper portion 68 and a reduced lower portion 70, and it is dimensioned and configured to be received on the main portion 38 so that the upper portion 68 is in mating engagement with the mating portions 52 and 54 and so that the lower portion 70 is in mating engagement with the raised portions 56 and 58. Accordingly, the upper portion 68 of the panel 40 cooperates with the main portion 38, specifically in the area of the upper portion of the channel 50, to define a generally downwardly extending inlet slot 72 which is dimensioned to receive a token 12. A slotted inlet cover plate 73 is secured to the main portion 38 and the panel 40 so that it communicates with the inlet slot 72 for providing access thereto. Beneath the inlet slot 72, the lower portion of the channel 50 defines an area of the acceptor 14 designated as an upper token station 74 which will hereinafter be more fully described, and immediately beneath the upper station 74 is an area of the acceptor which is designated as a lower token station 76 which will also hereinafter be more fully described. As illustrated most clearly in FIG. 4, the lower panel 42 is formed with first, second and third raised blocks 78, 80 and 82, respectively, adjacent the lower edge thereof, and an elongated laterally extending actuator slot 84 extends through the lower panel 42. The lower panel 42 is mounted on the main portion 38 so that the blocks 78, 80 and 82 are in engagement with the planar surface 60; and accordingly, the surface 60 cooperates with the blocks 78 and 80 to define a first outlet slot 86 in the body 26, and the blocks 80 and 82 cooperate to define a second outlet slot 88 therein. When the panel 42 is received on the main portion 38 in this manner, the actuator slot 84 is generally aligned with the slot actuator 66.

Figure 3:
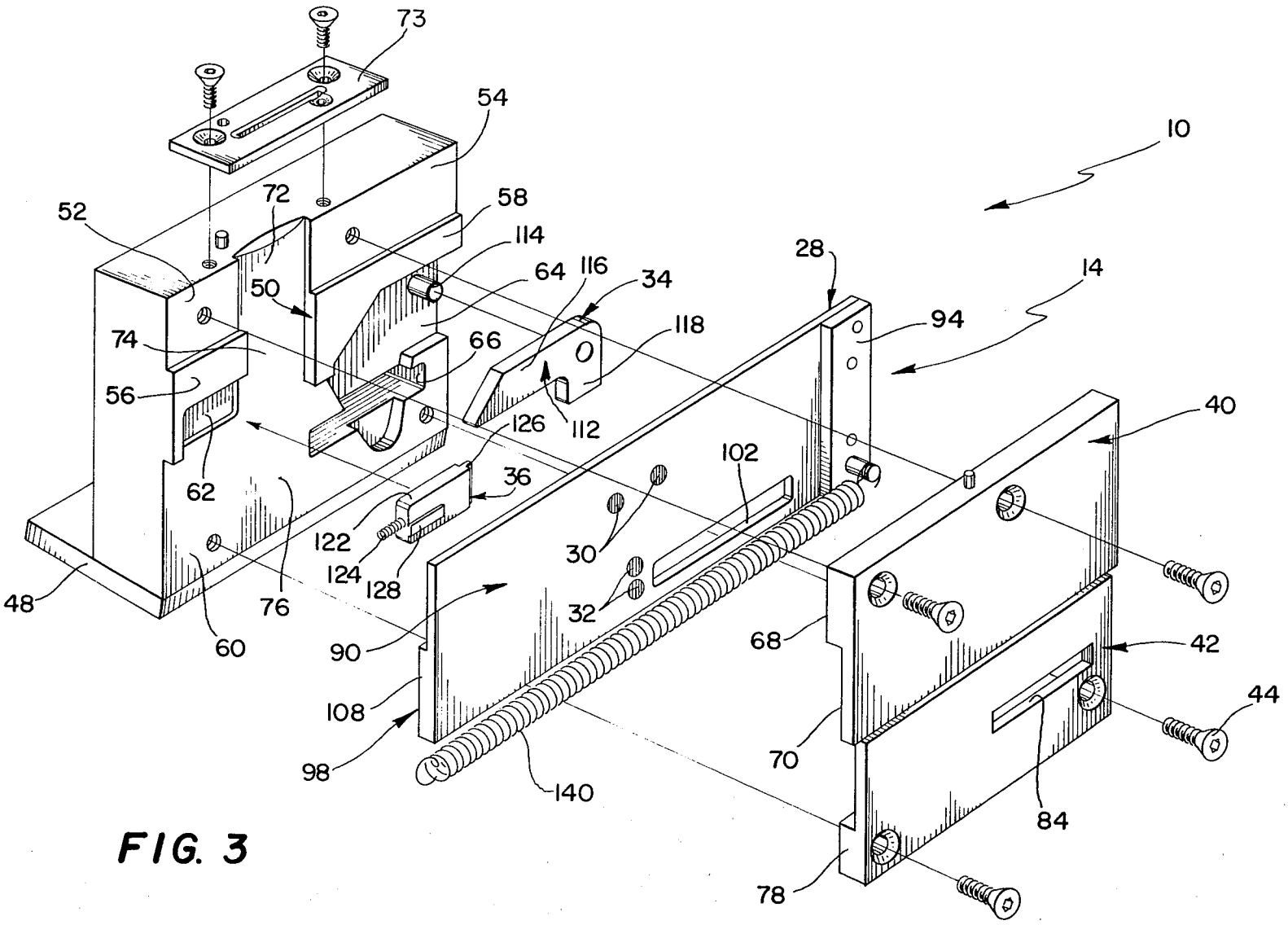
FIG. 3 is an exploded perspective view of the acceptor.
Figure 4:
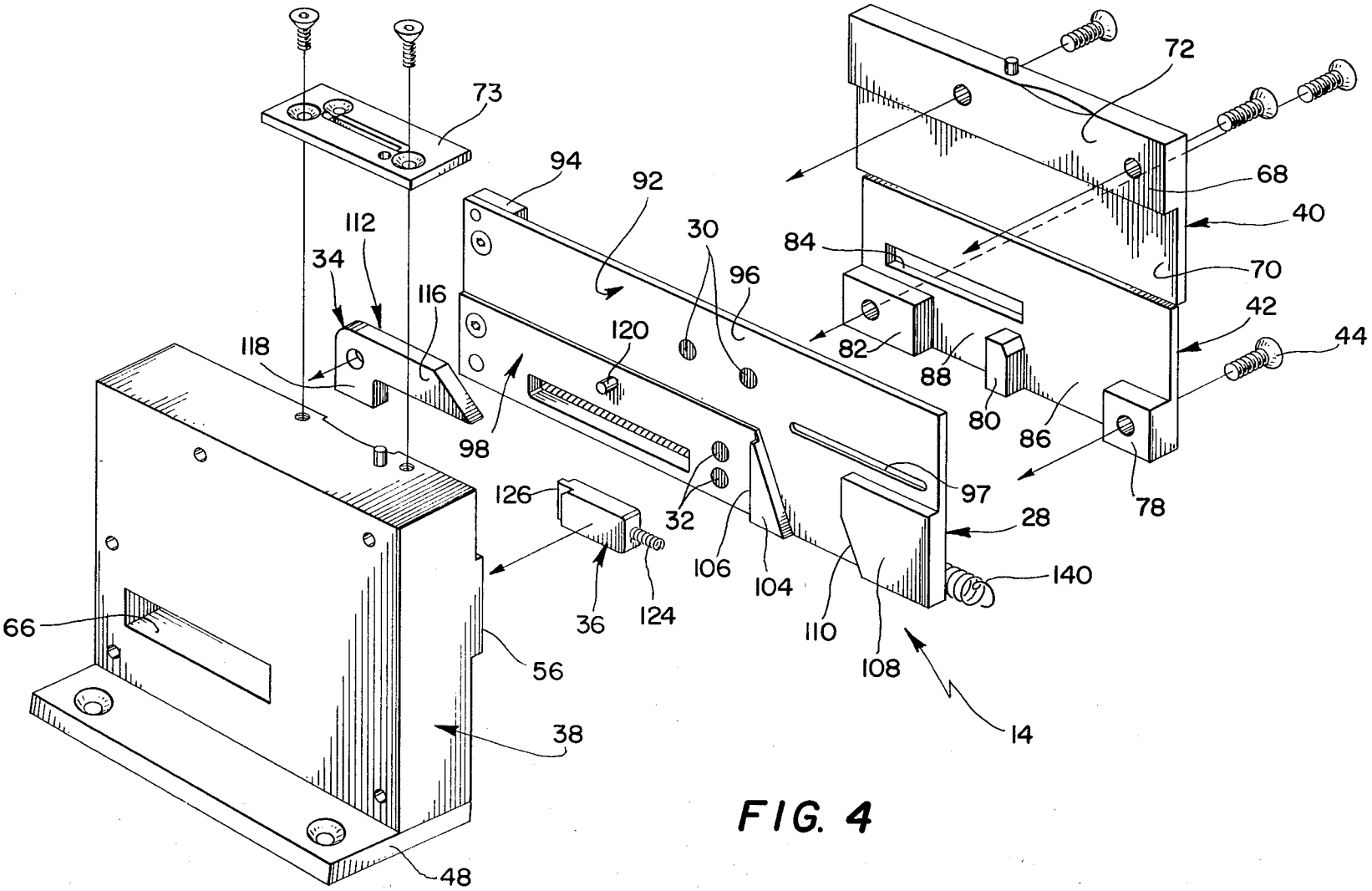
FIG. 4 is another exploded perspective view thereof.
Figure 5:
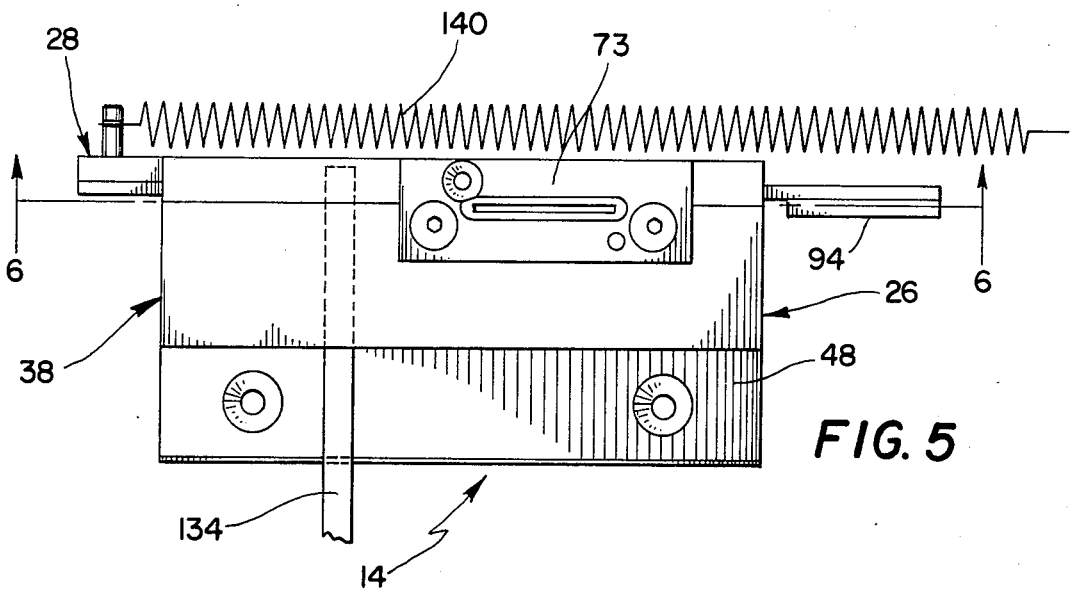
FIG. 5 is a top plan view of the acceptor.

The slide 28 is more clearly illustrated in FIGS. 3 and 4, and it is preferably constructed of a nonmagnetically responsive material in a generally elongated configuration. The slide 28 is slidably received in the body 26 between the main portion 38 and the panels 40 and 42 and has a first side generally indicated at 90 which is most clearly illustrated in FIG. 3 and a second side generally indicated at 92 which is most clearly illustrated in FIG. 4. The first side 90 faces the main portion 38 and is of generally planar configuration, although it has a substantially vertically extending stop bar 94 secured at one end thereof. The second side 92 of the slide 28 faces the panels 40 and 42 and is formed with an elongated upper portion 96 of generally planar configuration, having an elongated longitudinally extending escrow groove 97 therein, and a lower portion generally indicated at 98. The lower portion 98 includes an elongated slightly raised area 100 through which an elongated actuator slot 102 extends; and a further raised carrier member 104 of generally triangular configuration having a substantially vertical carrier edge 106 is also provided in the lower slide portion 98, the carrier member 104 being positioned so that the carrier edge 106 defines the inner end of the raised area 100. Also included in the lower portion 98 is a raised block 108 which is positioned in spaced relation to the carrier member 104 in order to define a counterfeit token guide channel 110 therebetween, the channel 110 and the block 108 being positioned generally beneath the groove 97 in the upper portion 96.

Figure 6:
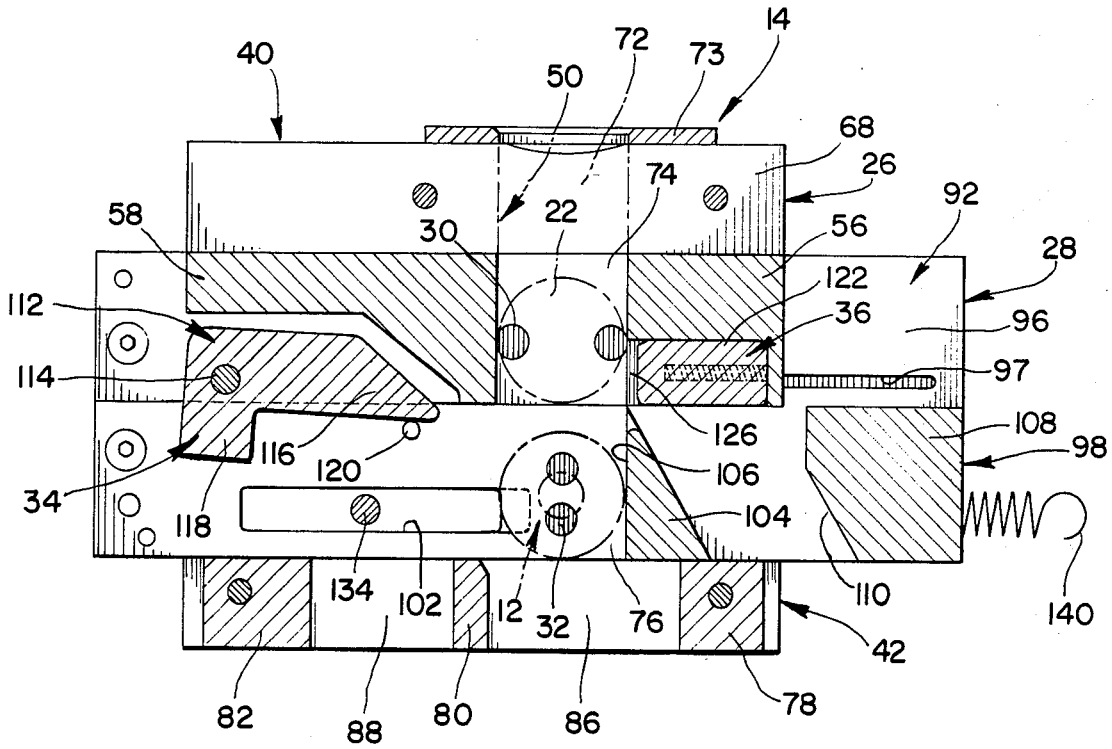
FIG. 6 is a sectional view taken along line 6—6 in FIG. 5.

The slide 28 is assembled in the body 26 so that its lower edge travels on the upper edges of the blocks 78, 80 and 82 and so that the slide 28 is contained at its upper edge by the upper portion 68 of the panel 40. When the slide 28 is mounted in the body 26 in this manner, it is operative between a first position illustrated in FIG. 6 and a second positioned illustrated in FIG. 8. When the slide is in its first position, the stop bar 94 engages the body 26 along the edge thereof adjacent the wiper assembly 34 and the raised portion 58. When the slide 28 is in this position, the actuator slot 102 is generally aligned with the actuator slots 66 and 84; although as illustrated in FIG. 6, the slot 102 extends slightly further inwardly at the inner end thereof in a direction toward the carrier edge 106 than either of the slots 66 or 84. Further, when the slide 28 is in its first position, the carrier member 104 is located generally beneath the raised portion 58 so that the carrier edge 106 is generally aligned with the edge of the channel 50. Because the area 100 is only slightly raised and the carrier member 104 is raised to a substantially greater extent, when the slide 28 travels in the body 26, the area 100 is maintained in spaced relation to the planar surface 60 so that there is clearance for a token to be received therebetween. Hence, when the slide 28 is in its first position, there is sufficient clearance for a token to pass between the surface 60 and the area 100 at the lower station 76 so that the token drops into the first outlet slot 86 unless it is retained at the lower station 76. Further, as illustrated most clearly in FIG. 9, when the slide 28 is mounted in this manner, the surface of upper portion 96 on the side 92 of the slide 28 at the upper station 74 is offset with respect to the inlet slot 72 so that the sectional dimension of the open area at the upper station 74 is approximately double the sectional dimension of the inlet slot 72 whereby two tokens can be accommodated in face-to-face relation at the upper station 74.

Figure 8:
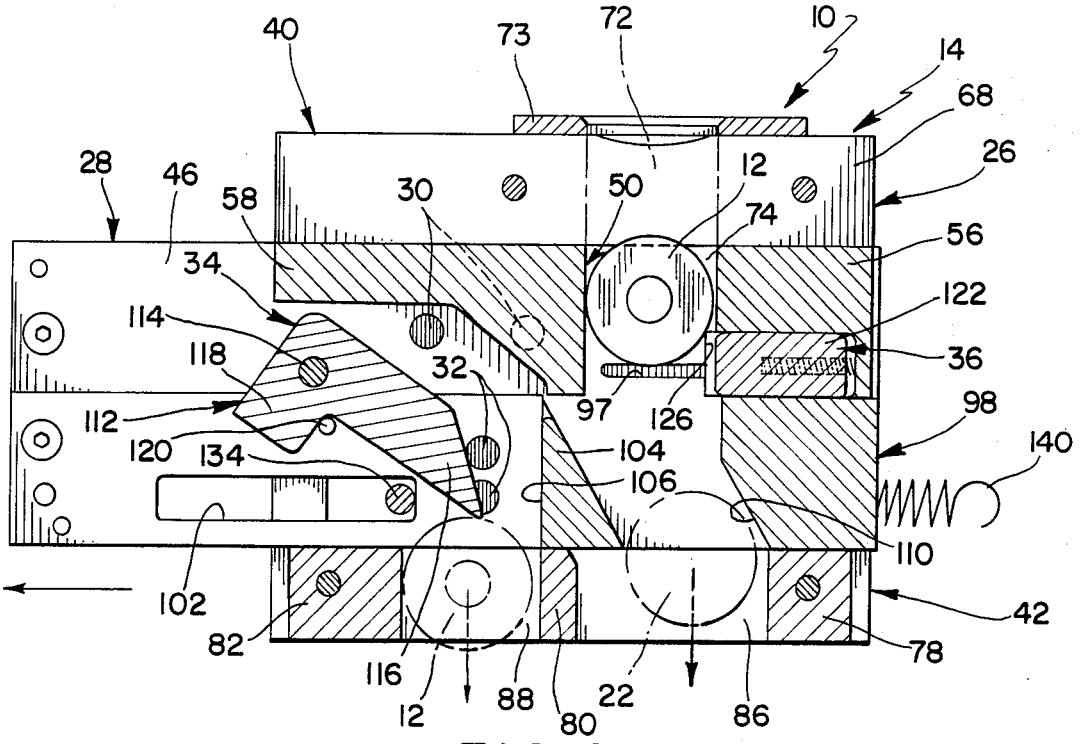
FIGS. 7 and 8 are similar sectional views illustrating the sequential operation of the acceptor.

The second position of the slide 28 is illustrated in FIG. 8. As will be seen, when the slide 28 is in its second position, the guide slot 110 is generally aligned with the first outlet slot 86, and the carrier edge 106 is generally aligned with the edge of the block 80 which is adjacent the second outlet slot 88. When the slide 28 is in this position, the actuator slot 102 is laterally displaced from its position of general alignment with the actuator slots 84 and 66 so that the inner end of the slot 102 is disposed generally above the second outlet slot 88.

Figure 7:
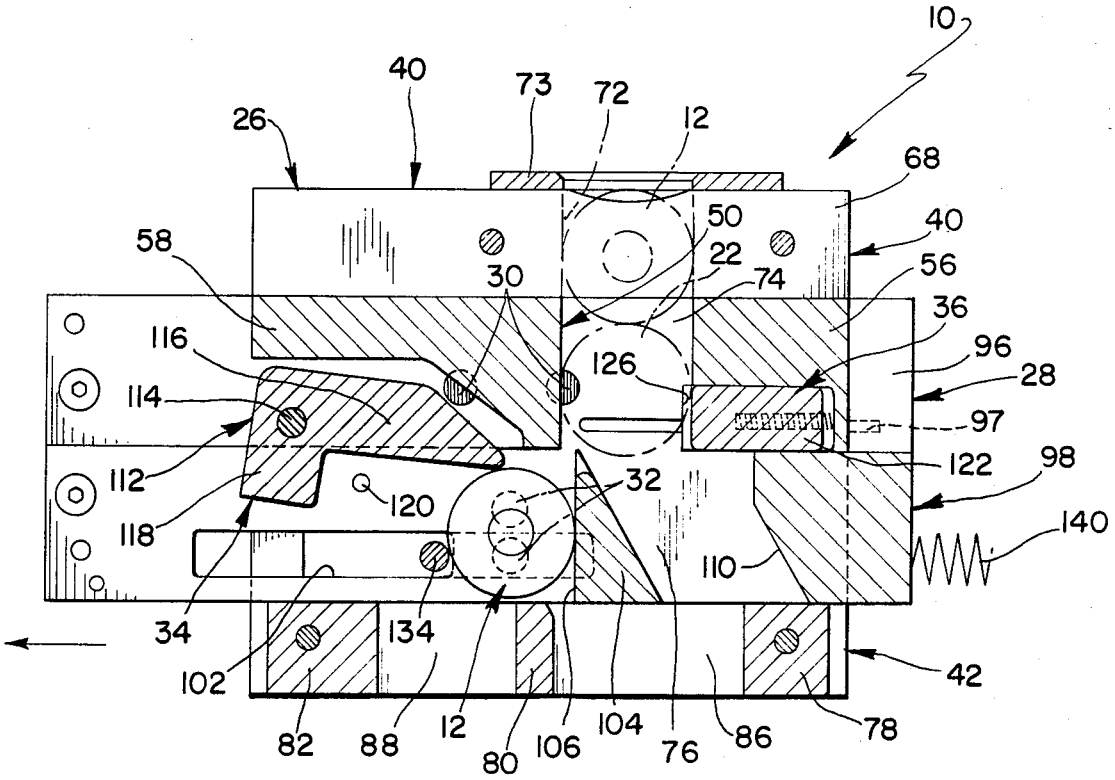

The first magnets 30 are positioned in spaced relation on the slide 28 so that when the slide 28 is in its first position, the magnets 30 communicate with the upper station 74 in the opposite peripheral edge portions thereof but not in the central portions thereof as illustrated in FIG. 6. Further, it should be pointed out that the magnets 30 are located in the upper portion 96 of the slide 28, and hence they are slightly offset with respect to the inlet slot 72 as illustrated in FIG. 9. It will be understood that other embodiments of the acceptor wherein one or more magnetic elements are positioned to communicate with tokens in only one peripheral edge portion are also contemplated. The second magnets 32 are positioned in the raised area 100 of the slide 28 substantially beneath the midpoint between the two first magnets 30. Accordingly, as will be seen from FIG. 6, when the slide 28 is in its first position, the second magnets 32 are located at the lower token station 76 and are positioned so that they communicate with the central portion of the token path in the acceptor 14 which is generally defined by the inlet slot 72, the upper station 74 and the carrier edge 106. It will be understood that other embodiments of the instant invention which include only a single magnet 32 are also contemplated, the important point being to provide a magnetic means which is positionable to communicate with the central portion of a token. As illustrated in FIGS. 7 and 8, when the slide 28 is moved to its second position, the first magnets 30 travel with the slide 28 so that they no longer communicate with the upper station 74, and the second magnets 32 are moved laterally with the slide 28 so that they no longer communicate with the lower station 76. The second magnets 32 are, however, positioned generally above the second outlet slot 88 when the slide 28 is in its second position.

The wiper assembly 34 comprises a wiper member 112 which is received in the recess 64 and pivotally mounted on a pin 114 therein. The wiper member 112 is of generally L-shaped configuration having longer and shorter legs 116 and 118, respectively. The wiper assembly 34 further comprises a wiper pin 120 which is mounted on the slide 28 above the slot 102 in the raised area 100. The pin 120 is positioned so that when the slide 28 is in its first position, the pin 120 engages the lower edge of the longer leg 116 to maintain it in a generally horizontal disposition. However, when the slide 28 is moved to its second position, the pin 120 travels along the lower edge of the longer leg 116 toward the shorter leg 118 so that the free end of the longer leg 116 is allowed to gravitate downwardly. The pin 120 eventually engages the shorter leg 118 as the slide 28 is moved further towards its second position so that the pin 120 causes the wiper member 112 to be further pivoted on the pin 114 whereby the longer leg 116 is moved to a position wherein it extends entirely across the raised area 100 when the slide 28 reaches its second position.

The escrow mechanism 36 comprises an escrow member 122 and a spring 124. The escrow member 122 is of generally rectangular configuration, although it has a tongue 126 formed at one end thereof and an elongated track member 128 formed along one side thereof. The escrow mechanism 36 is received in the recess 62 adjacent the upper station 74 so that the spring 124 biases the member 122 toward the upper station 74. The escrow member 122 is dimensioned to travel toward and away from the station 74 in the recess 62 between an operative or engaging position wherein the tongue 126 projects into the open area at the upper station 74 and an inoperative or disengaged position wherein the tongue 26 is withdrawn from the open area at the station 74. The track member 128 is configured and dimensioned to be slidably received in the groove 97 in the slide 28. Further in this regard, the track member 128 and the groove 97 are formed so that when the slide 28 is in the first position thereof, the track 128 engages an end of the groove 97 to move the escrow mechanism 36 to its disengaged position wherein the tongue 126 is withdrawn from the open area at the station 74. The track member 128 and the groove 97 are also formed so that the opposite end of the groove 97 engages the track member 128 when the slide 28 reaches its second position, whereby the track member 128 and the groove 97 provide a means for preventing further travel of the slide 28 beyond the second position thereof.

Figure 2:
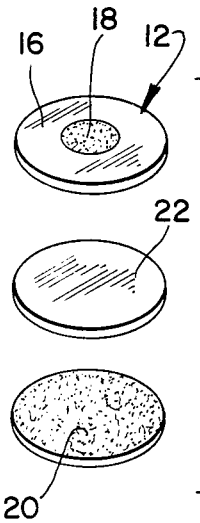
FIG. 2 is a perspective view of a valid token and two types of counterfeit tokens.

The turnstile assemby 24, which in and of itself comprises no part of the instant invention, is schematically illustrated in FIG. 1 for the purpose of demonstrating the general type of conventional secondary system which can be actuated by the token system 10. Accordingly, it will be understood that the turnstile system 24 is not intended to be an accurate representation of and operative turnstile system, but merely a general schematic representation thereof. The turnstile assembly 24 is operative in response to the operation of the acceptor 14 when a valid token 12 is received therein, and comprises a turnstile 130 having a center hub 132, an actuator member 134, an actuator return spring 135, a release member 136, a half-turn latch member 138 and a latch return spring 140. The actuator member 134 is pivotally mounted at one end thereof as at 142, and the opposite end of the actuator member 134 extends into the slot 66 in the main portion 38 of the body 26, and also into the slot 102 in the slide 28. The latch member 138 is secured to the slide 28 as at 144, and it is dimensioned and configured so that when the slide 28 is in the first position thereof, the latch member 138 engages a tooth 146 on the hub 132 and the spring 140 is secured to the latch member 138 to bias the slide 28 to its first position. The release member 136 is secured at one end thereof to the actuator member 134 in substantially perpendicular relation, and is biased by the spring 135 to a position wherein the other end of the release member 136 is received in a notch 148 in the hub 132 when the slide 28 is in the first position thereof. In order to actuate the turnstile assembly 24, the turnstile 130 is rotated slightly to move the slide 28 with the latch member 138. However, in order for the turnstile 130 to be rotated a significant amount, the end of the actuator member 134 which is received in the slots 66 and 102 must be moved a sufficient distance laterally with the slide during the first portion of its travel in order to remove the release member 136 from the notch 148 so that the turnstile 130 can be rotated further to move slide 28 to its second position with the latch member 138. This only occurs when a valid token 12 is carried on the slide 28 so that the token 12 engages the actuator member 134 during the initial portion of the movement of the slide 28. Otherwise, the actuator member 134 remains in the notch 148 so that the turnstile 130 cannot turn a significant amount. However, after the release member 136 is released so that the slide 28 can travel toward its second position, the latch member 138 passes over the tooth 146, whereby the spring 140 returns the slide 28 to its first position so that the release member 136 is received in the other notch 148. Accordingly, it is seen that the turnstile mechanism 24 is actuated for a half rotation of the turnstile 130 when the end of the actuator member 134 which is received in the slots 66 and 102 is moved by an amount sufficient to remove the release member 136 from the notch 148 during the first portion of the travel of the slide 28.

For use and operation of the acceptor 14 for segregating valid tokens 12 from other types of tokens, such as the tokens 20 and 22, the slide 28 is positioned at its first position, and a token is positioned in the inlet slot 72. If the token is a nonmagnetically responsive counterfeit token 20, it is unaffected by the first magnets 30 at the upper station 74 and since the escrow mechanism 36 is in its disengaged position when the slide 28 is in its first position, the token 20 is free to pass to the second station 76. Since a nonmagnetically responsive token 20 is also unaffected by the second magnets 32, it passes through the lower station 76 and into the first outlet slot 86 and is released from the acceptor 14. If, on the other hand, the token which is inserted into the inlet slot 72 is a counterfeit token 22 or some other type of counterfeit token which is magnetically responsive in its peripheral portions, it is retained by the first magnets 30 at the upper station 74. In this connection, the magnets 30 are positioned to communicate with only the peripheral portions of the token 22 and they are operative to draw the token 22 to a position of engagement with the slide 28 wherein it is offset relative to the inlet slot 72 as illustrated in FIG. 9. When the slide 28 is thereafter moved to the second position thereof so that the first magnets 30 are moved laterally until they no longer communicate with the upper station 74 the token 22 engages the channel 50 so that it is released from the magnets 30. Since the token 22 is offset with respect to the inlet slot 72, when it is released in this manner, it can pass by the tongue 126; and when the slide 28 reaches its second position, the token 22 falls into the guide channel 110 and into the first outlet slot 86 where it is released from the acceptor 14.

On the other hand, if a valid token 12 is inserted into the acceptor 14 it passes into the inlet slot 72 and into the upper station 74. When the slide 28 is moved to the first position thereof, the valid token is released from the escrow mechanism 36; and since the valid token 12 is nonmagnetically responsive in its peripheral portion 16, it is substantially uneffected by the magnets 30 and passes to the lower station 76. Since the magnets 32 at the lower station 76 are positioned generally in the center of the path of travel of the token 12 as defined by the inlet slot 72, the channel 50 and the carrier edge 106, the magnets 32 magnetically communicate with the magnetically responsive central portion 18 of the token 12 to retain the token 12 at the lower station 76. When the slide 28 is then moved to the second position thereof, the token 12 is carried with the slide 28, and the lateral travel of the token 12 is further assured by the carrier member 104 which is engageable with the token 12 to advance it laterally with the slide. As the slide 28 is moved toward its second position, the wiper mechanism actuator pin 120 is moved toward the shorter leg 118 allowing the longer leg 116 to gravitate downwardly until it engages the token 12. As the slide 28 is further moved laterally, the longer leg 116 is cammed upwardly by the token 12 until the actuator pin 120 engages the shorter leg 118 causing the actuator member 112 to be pivoted on the pin 114 so that the longer leg 116 is urged downwardly. More specifically, the actuator pin 120 engages the wiper member 112 to cause the longer leg 116 to wipe across the raised area 100 of the slide 28 in the area of the second magnets 32 so that the token 12 is wiped from the slide 28 and dropped into the second outlet slot 88.

Because of the unique construction of the acceptor 14, it is also possible for it to operate simultaneously with two tokens, one valid token and one counterfeit token. For instance, if a magnetically responsive counterfeit token 22 is inserted into the inlet slot 72, the token 22 is retained by the first magnets 30 at the upper station 74 when the slide 28 is in the first position thereof. Since the counterfeit token 22 is retained in a position wherein it is offset with respect to the inlet slot 72, it is actually removed from the path which extends from the inlet slot 72. Accordingly, there is sufficient clearance at the upper station 74 to accommodate a second token, and therefore when a valid token 12 is inserted into the inlet slot, it gravitates downwardly to the lower station 76 without being interferred with by the counterfeit token 22 at the upper station 74. The smooth passage of the valid token 12 by the counterfeit token 22 at the upper station is further enhanced by the fact that the acceptor body 26 is mounted so that it is inclined slightly toward the main portion 38, whereby the valid token 12 is gravitationally urged away from the token 22 at the upper station 74. When the token 12 reaches the lower station 76, however, it is retained by the second magnets 32. Thereafter, when the slide 28 is moved to the second position thereof, the counterfeit token 22 is removed from the first magnets 30 at the upper station so that it falls through the guide channel 110 into the first outlet slot 86, and the valid token 12 is carried by the slide 28 to a point adjacent the second outlet slot 88 where it is removed from the slide 28 by the wiper mechanism 34.

The acceptor 14 is also operable with various other combinations of tokens 12, 20 and 22, but in each case the acceptor 14 segregates the tokens 12 so that they pass through the second outlet slot 88, whereas the counterfeit tokens 20 and/or 22 pass through the first outlet slot 86. It is, however, impossible to operate the acceptor 14 so that two valid tokens are passed therethrough during a single cycle of the slide 28 from its first position to its second position and back to its first position. For example, if a valid token 12 is inserted into the inlet slot 72 so that it passes to the lower station 76 where it is held by the second magnets 32 and a second valid token is then inserted into the inlet slot 72, the second token engages the first token and remains at the upper station 74. Accordingly, even if the escrow mechanism 36 is moved to the disengaging position thereof, the second valid token 12 nevertheless remains at the upper station 74; and when the slide 28 is moved to the second position thereof, the escrow member 36 engages the second valid token 12 to retain it at the upper station 74 while the first valid token is moved laterally by the slide 28 until it passes out the second outlet slot 88. When the slide 28 is then returned to its first position so that the escrow mechanism 36 is moved to its disengaging position, the valid token positioned at the upper station 74 is allowed to gravitate downwardly to the lower station 76 where it is retained by the magnets 32. Accordingly, when the slide 28 is then moved to the second position thereof, the second valid token 12 is also passed into the second outlet slot 88.

While in some applications, such as in many gaming system applications, the requirements for a token system are fulfilled if the system can effectively segregate valid tokens from counterfeit tokens, in other applications it is necessary for a token system to be operative for actuating the operation of a secondary system in response to receiving a valid token. As hereinabove stated, the turnstile assembly 24 illustrated in FIG. 1 is exemplary of a system of this general type and requires that the actuator member 134 be moved a sufficient amount during the first portion of the travel of the slide 28 from its first position in order to release the turnstile 130 for a half revolution. The sequential operation of the acceptor 14 to operate the actuator member 134 in this manner is also illustrated in FIGS. 6 through 8. In this regard, prior to moving the actuator member 134 to release the release member 136, the actuator member 134 is positioned at the inner end of the slot 102 in the slide 28, i.e., it is positioned at the end of the slot 102, which is closest to the carrier member 104. When a valid token 12 is positioned at the lower station 76 and the slide 28 is moved toward the second position thereof, the token 12 engages the actuator member 134 during the first portion of the travel of the slide 28. This causes the actuator member 134 to be moved a sufficient amount to release the release member 136 from the notch 148. If, however, an attempt is made to move the slide 28 from its first position to its second position without a valid token 12 positioned at the lower station 76, the slide 28 is required to travel a greater distance before the actuator member 134 is finally engaged by the inner end of the slot 102. However, since the turnstile assembly 24 is only operative for releasing the release member 136 if the actuator member 134 is moved during the first portion of the travel of the slide 28, the turnstile 130 remains locked in this situation. Accordingly, it is seen that when the acceptor 14 is used to actuate the operation of the secondary system actuating device, the slide 28 can only be moved to the second position thereof after a valid token 12 has been positioned at the lower station 76. As a result, if a magnetically responsive counterfeit token 22 is inserted into the inlet slot 72 so that it is retained at the upper station 74, it is necessary for a valid token 12 to be fed into the inlet slot 72 so that it gravites downwardly past the counterfeit token 22 to the lower station 76 before the counterfeit token 22 can be cleared from the acceptor 14. However, when the valid token 12 is positioned at the lower station 76 and the slide 28 is moved toward the second position thereof, both the valid token 12 and the counterfeit token 22 are cleared from the acceptor 14 and pass through the outlet slots 88 and 86, respectively.

It is seen therefore that the instant invention provides a very effective token system which can be used to segregate valid tokens from counterfeit tokens and also to actuate the operation of a secondary system actuating device such as the actuator member 134 of the turnstile system 24. The acceptor 14 is extremely simple in its operation, having only three moving parts, but nevertheless, it reliably segregates valid tokens from counterfeit tokens so that it can be reliably used in a number of applications for extended periods of time. Accordingly, for these reasons, as well as the other reasons hereinabove set forth, it is seen that the token system of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A magnetically selective token system comprising:

(a) a magnetically responsive valid token having a nonmagnetically responsive peripheral portion; and (b) a token acceptor comprising:

(i) an acceptor body made of nonmagnetically responsive material having a token inlet slot and first and second token outlet slots therein, said body also having an upper token station therein for receiving tokens from said inlet slot and a lower token station therein for receiving tokens from said upper station;

(ii) first magnetic means operative at said upper token station for magnetically communicating with the peripheral edge portions of a valid token positioned at said upper station but not with other portions of said valid token so that when said valid token is positioned at said upper station it is substantially unaffected by said first magnetic means but so that when a magnetically responsive counterfeit token having a similar dimension and configuration to said valid token and having a magnetically responsive peripheral portion is positioned at said upper station it is retained at said upper station by said first magnetic means;

(iii) second magnetic means operative at said lower token station for magnetically communicating with the nonperipheral edge portions of said valid token when it is positioned at said lower station to retain it at said lower station;

(iv) means operative for removing said counterfeit token from said upper station and for guiding it to said first outlet slot; and (v) means operative for removing said valid token from said lower station and for guiding it to said second outlet slot.

2. In the token system of claim 1, said valid token removing means being operative for actuating the operation of a secondary system actuating device in response to the operation of said valid token removing means for removing said valid token.

3. In the token system of claim 1, said valid token removing means and said counterfeit token removing means being interconnected for simultaneous operation.

4. In the token system of claim 3, said valid token removing means and said counterfeit token removing means comprising a slide made of a nonmagnetically responsive material, said slide being slidably mounted in said body and communicating along one side thereof with said upper and lower stations.

5. In the token system of claim 4, said first magnetic means being mounted on said slide.

6. In the token system of claim 4, said second magnetic means being mounted on said slide.

7. In the token system of claim 5, said second magnetic means being mounted on said slide.

8. In the token system of claim 7, said slide being operative between a first position wherein said first magnetic means is positioned at said upper station and said second magnetic means is positioned at said lower station and a second position wherein neither of said first or second magnetic means is in communication with either of said upper or lower stations, said counterfeit and valid tokens being removed from said upper and lower stations, respectively, and being guided to said first and second outlet slots, respectively, upon movement of said slide to said second position thereof.

9. In the token system of claim 8, said body having means formed therein adjacent said upper station for engaging said counterfeit token when said slide is moved from the first position thereof to the second position thereof to release said counterfeit token from said first magnetic means, said inlet slot communicating with said first outlet slot when said slide is in said second position thereof so that when said counterfeit token is released from said first magnetic means, it drops into said first outlet slot and is released from said body.

10. In the token system of claim 8, said valid token traveling with said slide to a position adjacent said second outlet slot upon movement of said slide to said second position thereof, said valid token removing means further comprising a wiper arm responsive to movement of said slide toward said second position thereof for engaging said valid token to remove it from said second magnetic means so that it drops into said second outlet slot and is released from said body.

11. In the token system of claim 10, said slide having a carrier member thereon, said carrier member being engageable with said valid token to assure that it travels laterally with said slide to said position adjacent said second outlet slot when said slide is moved to said second position thereof.

12. In the token system of claim 10, said valid token removing means being operative for actuating the operation of a secondary system actuating device in response to the operation of said slide for removing said valid token.

13. In the token system of claim 12, said valid token being engageable with said secondary system actuating device to effect the actuation thereof upon movement of said slide toward said second position thereof.

14. In the token system of claim 13, said body having a laterally extending slot therein, said slide also having a laterally extending slot therein which is generally aligned with said laterally extending body slot when said slide is in said first position thereof, said valid token being engageable with said secondary system actuating device adjacent the slot in said slide.

15. The token system of claim 1 further comprising escrow means communicating with said upper station for preventing the advancement of a second valid token past said upper station while a first valid token is in communication with said second magnetic means.

16. In the token system of claim 15, said escrow means being operative to permit the passage of a valid token from said upper station when a valid token is not received at said lower station by moving said slide to said first position thereof.

17. In the token system of claim 1, said upper station communicating through said lower station with said first outlet slot when said first magnetic means is operative at said upper station and said second magnetic means is operative at said lower station to permit the passage of a nonmagnetic counterfeit token from said inlet slot said first outlet slot.

18. In the device of claim 8, said inlet slot communicating with said first outlet slot when said slide is in either of said first or second positions thereof to permit the passage of a nonmagnetic counterfeit token through said inlet slot and into said first outlet slot.

19. In the device of claim 5, said inlet slot having a sectional dimension which is slightly greater than the sectional dimension of a valid token, said upper station extending from said inlet slot, said slide being disposed in offset relation with respect to said inlet slot at said upper station so that when said megnetically responsive counterfeit token is received at said upper station it is offset with respect to said inlet slot, said upper station being dimensioned to permit the passage of a second token of similar dimension and configuration to said magnetically responsive counterfeit token in face-to-face relation therewith at said upper station.

20. In the device of claim 19, said inlet slot being inclined slightly in a direction away from said slide to facilitate the passage of said second token past said magnetically responsive counterfeit token at said upper station.

* * * * *